US006045206A

United States Patent [19]

Igval

[11] Patent Number: 6,045,206

[45] Date of Patent: Apr. 4, 2000

[54] INK-JET PRINTER HAVING VARIABLE MAINTENANCE ALGORITHM

[75] Inventor: Yakup J. Igval, Milford, Conn.

[73] Assignee: Pitney Bowes Inc., Stamford, Conn.

[21] Appl. No.: 09/020,921

[22] Filed: Feb. 9, 1998

[51] Int. Cl.[7] ..... B41J 3/00; B41J 2/165

[52] U.S. Cl. ..... 347/2; 347/19; 347/23

[58] Field of Search ..... 347/14, 23, 2; 399/9, 10

[56] References Cited

U.S. PATENT DOCUMENTS

| | | | |
|---|---|---|---|
| 4,202,267 | 5/1980 | Heinzl et al. | 101/364 |
| 4,566,014 | 1/1986 | Paranjpe et al. | 346/25 |
| 4,926,196 | 5/1990 | Mizoguchi et al. | 346/140 R |
| 4,965,596 | 10/1990 | Nagoshi et al. | 347/36 |
| 5,068,806 | 11/1991 | Gatten et al. | 358/1.14 |
| 5,132,711 | 7/1992 | Shinada et al. | 347/6 |
| 5,172,140 | 12/1992 | Hirabayashi et al. | 347/36 |
| 5,296,876 | 3/1994 | Yamaguchi et al. | 347/23 |
| 5,305,199 | 4/1994 | LoBiondo et al. | 705/28 |
| 5,321,436 | 6/1994 | Herbert | 347/19 |
| 5,365,312 | 11/1994 | Hillmann et al. | 399/12 |
| 5,382,969 | 1/1995 | Mochizuki et al. | 347/23 |
| 5,412,779 | 5/1995 | Motoyama | 349/8 |
| 5,414,452 | 5/1995 | Accatino et al. | 347/7 |
| 5,467,709 | 11/1995 | Salomon et al. | 101/93 |
| 5,473,350 | 12/1995 | Mader et al. | 347/7 |
| 5,513,563 | 5/1996 | Berson | 101/91 |
| 5,537,554 | 7/1996 | Motoyama | 710/100 |
| 5,544,289 | 8/1996 | Motoyama | 710/100 |
| 5,568,618 | 10/1996 | Motoyama | 710/100 |
| 5,583,547 | 12/1996 | Gast et al. | 347/22 |
| 5,606,353 | 2/1997 | Mochizuki et al. | 347/23 |
| 5,635,961 | 6/1997 | Sato | 347/7 |

FOREIGN PATENT DOCUMENTS

| | | |
|---|---|---|
| 62092850 | 4/1987 | European Pat. Off. . |
| 0714776 | 11/1995 | European Pat. Off. . |
| 2 272 789 | 5/1994 | United Kingdom . |
| WO92/18335 | 10/1992 | WIPO . |

OTHER PUBLICATIONS

U.S. application No. 08/764,291, Murphy, filed Dec. 12, 1996 .

U.S. application No. 08/701,897, Lefebvre et al. filed Aug. 23, 1996.

*Primary Examiner*—John Barlow
*Assistant Examiner*—Craig A. Hallacher
*Attorney, Agent, or Firm*—Angelo N. Chaclas; Michael E. Melton

[57] ABSTRACT

An ink jet printer and a method of operating and ink jet printer are disclosed. The method includes using a maintenance algorithm to control timing of a maintenance action, keeping a historical log of an operating characteristic of the ink jet printer over a period of time, and changing the maintenance algorithm for subsequent use by the ink jet printer based upon the historical log. The ink jet printer has a memory which stores the plurality of maintenance algorithms within. A control device keeps the historical log of the operating characteristics of the ink jet printer over time. The control device also associates the plurality of maintenance algorithms with a plurality of user profiles which are representative of different usage patterns with respect to the operating characteristics. The control device then determines which one of the plurality of user profiles is best suited to the historical log and selects one of the plurality of maintenance algorithms corresponding to the determined user profile.

10 Claims, 3 Drawing Sheets

200

| ACTIONS | RELATIVE INK CONSUMPTION |
|---|---|
| PRINTING ACTIONS : | |
| INDICIA | 2 |
| AD SLOGAN | 1 |
| MAINTENANCE ACTIONS : | |
| WIPE | 0 |
| CAP | 0 |
| NORMAL FLUSH | 1 |
| POWER FLUSH | 12 |
| NORMAL PURGE | 1,000 |
| POWER PURGE | 4,000 |

200

| ACTIONS | RELATIVE INK CONSUMPTION |
|---|---|
| PRINTING ACTIONS : | |
| INDICIA | 2 |
| AD SLOGAN | 1 |
| MAINTENANCE ACTIONS : | |
| WIPE | 0 |
| CAP | 0 |
| NORMAL FLUSH | 1 |
| POWER FLUSH | 12 |
| NORMAL PURGE | 1,000 |
| POWER PURGE | 4,000 |

FIG. 3

| USER PROFILES | |
|---|---|
| USER PROFILE # 1 | • SPARSE USAGE EVERY DAY.<br>• ≈ 1-2 MAILPIECES PER BATCH.<br>• ≈ 25 MAILPIECES PER WEEK. |
| USER PROFILE # 2 | • CONSTANT RANDOM USAGE EVERY DAY.<br>• ≈ 2-3 MAILPIECES PER BATCH.<br>• ≈ 100 MAILPIECES PER WEEK. |
| USER PROFILE # 3 | • CONSTANT USAGE EVERY DAY.<br>• 1 BATCH IN THE MORNING EVERY DAY.<br>• 1 BATCH IN THE AFTERNOON EVERY DAY.<br>• ≈ 10 MAILPIECES PER BATCH.<br>• ≈ 100 MAILPIECES PER WEEK. |
| USER PROFILE # 4 | • CONSTANT RANDOM USAGE EVERY DAY.<br>• ≈ 3-4 MAILPIECES PER BATCH.<br>• AT LEAST ONE BATCH PER WEEK > 50 MAILPIECES.<br>• INCLUDING SATURDAY USAGE.<br>• ≈ 200 MAILPIECES PER WEEK. |
| USER PROFILE # 5 | • 400 MAILPIECES EVERY FRIDAY MORNING.<br>• LITTLE USAGE DURING THE REMAINDER OF THE WEEK.<br>• ≈ 420 MAILPIECES PER WEEK. |

300

FIG . 4

| MAINTENANCE ALGORITHMS | |
|---|---|
| ALGORITHM # 1 | • NORMAL FLUSH - EVERY 1 HOURS AFTER PRINT.<br>• POWER FLUSH - JUST BEFORE PRINT & EVERY 2 HOURS AFTER PRINT.<br>• NORMAL PURGE - 2 X PER WEEK ON TUES. PM & THUR. PM.<br>• POWER PURGE - 1 X PER WEEK ON MONDAY AM. |
| ALGORITHM # 2 | • NORMAL FLUSH - EVERY 1 HOURS AFTER PRINT.<br>• POWER FLUSH - JUST BEFORE PRINT & EVERY 2 HOURS AFTER PRINT.<br>• NORMAL PURGE - 3 X PER WEEK ON MON. AM, TUES. PM & THUR. PM.<br>• POWER PURGE - NONE. |
| ALGORITHM # 3 | • NORMAL FLUSH - EVERY 4 HOURS AFTER PRINT.<br>• POWER FLUSH - JUST BEFORE PRINT.<br>• NORMAL PURGE - 1 X PER WEEK ON MON. AM.<br>• POWER PURGE - NONE. |
| ALGORITHM # 4 | • NORMAL FLUSH - EVERY 1 HOURS AFTER PRINT.<br>• POWER FLUSH - JUST BEFORE PRINT & EVERY 4 HOURS AFTER PRINT.<br>• NORMAL PURGE - NONE.<br>• POWER PURGE - NONE. |
| ALGORITHM # 5 | • NORMAL FLUSH - EVERY 1 HOURS AFTER PRINT.<br>• POWER FLUSH - JUST BEFORE PRINT & EVERY 3 HOURS AFTER PRINT.<br>• NORMAL PURGE -2 X PER WEEK ON MON. AM & WED. NOON.<br>• POWER PURGE - NONE. |

400

FIG. 5

INK-JET PRINTER HAVING VARIABLE MAINTENANCE ALGORITHM

FIELD OF THE INVENTION

This invention relates to ink jet printing technology. More particularly, this invention is directed to an ink jet printer having a variable maintenance algorithm that adapts to the actual usage patterns of the ink jet printer so as to optimize the consumption of ink.

BACKGROUND OF THE INVENTION

Ink jet printers are well known in the art. Generally, an ink jet printer includes an array of nozzles or orifices, a supply of ink, a plurality of thin channels connecting the array of nozzles with the ink supply, respectively, a plurality of ejection elements (typically either expanding vapor bubble elements or piezoelectric transducer elements) corresponding to the array of nozzles, respectively, and suitable driver electronics for controlling the ejection elements. Typically, the array of nozzles and the ejection elements along with their associated components are referred to as a print head. It is the activation of the ejection elements that causes drops of ink to be expelled from the nozzles. The ink ejected in this manner forms drops which travel along a flight path until they reach a print medium such as a sheet of paper, overhead transparency, envelope or the like. Once they reach the print medium, the drops dry and collectively form a print image. Typically, the ejection elements are selectively activated or energized as relative movement is provided between the print head and the print medium so that a predetermined or desired print image is achieved via the collective effect of the placement of the drops.

Generally, the array of nozzles, supply of ink, plurality of ejection elements and driver electronics are packaged into an ink jet cartridge. In turn, the printer includes a carriage assembly for detachably mounting the ink jet cartridge thereto. In this manner, a fresh ink jet cartridge may be installed when the ink supply of the current ink cartridge has been consumed. In other ink jet printers, the ink supply is remotely located from the print head and ink is delivered to the print head via a supply tube.

To keep an ink jet printer in proper working order, a variety of maintenance actions, such as capping, wiping, normal flushing, power flushing, normal purging and power purging, have been developed. Most of these maintenance actions are directed toward preventing the array of nozzles from becoming clogged with stale ink or other debris. When not in use, the print head is sealed off from ambient air by a cap. In this manner, the evaporation rate of any solvents or other volatiles contained within the ink is reduced and the ink is less prone to clumping. A wiper blade is typically employed to squeegee any excess ink or other debris off from the face plate of the array of nozzles. This cleaning action is typically performed both prior to capping and prior to printing. A normal flush involves firing each nozzle in the array of nozzles a predetermined number or times to expel ink that may be beginning to clump. A power flush is similar to a normal flush except that the number of time each nozzle is fired is substantially greater than that for a normal flush. A normal purge involves applying a vacuum for a predetermined amount of time to the array of nozzles to suck out ink. A power purge is similar to a normal purge except that the amount of time that the vacuum is applied is substantially greater than that for a normal purge.

Since ink that is consumed during maintenance actions is not available for printing, it is desirable to keep the maintenance actions to a minimum. In this manner, the overall cost to the user will be reduced by providing greater ink utilization. On the other hand, it is desirable to keep the print head operating at optimum conditions so that a high degree of reliability and print quality is achieved. In this manner, the user does not have to waster paper, ink and time reprinting items that were printed improperly. Thus, a tension exists between minimizing maintenance actions to conserve ink and providing a print head that is ready to produce high quality printed images on demand.

Recently, the postage meter industry and other envelope printing industries have begun to incorporate ink jet printers. A typical postage meter (one example of a postage printing apparatus) applies evidence of postage, commonly referred to as a postal indicia, to an envelope or other mailpiece and accounts for the value of the postage dispensed. As is well known, postage meters include an ascending register, that stores a running total of all postage dispensed by the meter, and a descending register, that holds the remaining amount of postage credited to the meter and that is reduced by the amount of postage dispensed during a transaction. Because U.S. Postal Service regulations require that postage be paid in advance, it had traditionally been required that the user of a postage meter periodically present the meter to a Postal Service employee for recharging. However, more recently it is possible to recharge a meter remotely using telephone communications. At the time of recharging, the user paid to the Postal Service the amount of postage to be credited to the meter and the meter is recharged by increasing the setting of the descending register by the amount paid. The postage meter generally also includes a control sum register which provides a check upon the descending and ascending registers. The control sum register has a running account of the total funds being added into the meter. The control sum register must always correspond with the summed readings of the ascending and descending registers. The control sum register is the total amount of postage ever put into the machine and it is alterable only when adding funds to the meter. In this manner, the dispensing of postal funds may be accurately tracked and recorded.

Due to the inherent nature of printing an indicia of value (a postal indicia being the equivalent of money), several issues arise with utilizing ink jet printing in a postage printing device. For example, if a general purpose ink jet printer runs out of ink while printing a document or suffers poor print quality, then the user merely installs a new cartridge and reprints the document. Although supplies are not optimally used, no direct loss of money occurs. On the other hand, if a postage printing device runs out of ink or suffers poor print quality while printing a postal indicia, then the user loses money because the postal funds associated with that postal indicia cannot be recovered. Therefore, it is highly desirable to avoid running out of ink and ensuring quality printing in a postage printing system such as a postage meter.

Thus, there is a need in ink jet printers to balance the competing interests of optimizing ink usage and maintaining print head readiness and print quality. In this way, the actual cost of the ink may be reduced because less ink is consumed during maintenance actions. However, this situation is often complicated due to the wide range of usage patterns that exist among users.

SUMMARY OF THE INVENTION

The present invention provides a cost effective apparatus and method for adapting the maintenance algorithm of an ink jet printer to optimize ink consumption in relation to the actual usage pattern of the ink jet printer. To accomplish this, a historical log of printing activity is maintained and periodically reviewed to determine if changes to the maintenance algorithm are warranted.

In conventional fashion, this invention may be incorporated into a variety of devices employing ink jet printing, such as: a postage printing system (postage meter, mailing machine, postage evidencing device, and the like), a data recording device using ink jet printing and a general purpose ink jet printer.

In accordance with the present invention, there is provided a method of operating an ink jet printer, comprising the step(s) of: using a maintenance algorithm to control timing of a maintenance action, keeping a historical log of an operating characteristic of the ink jet printer over a period of time, and changing the maintenance algorithm for subsequent use by the ink jet printer based upon the historical log.

An ink jet printer, a postage printing system and a method of operating a postage printing system are also provided.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

FIG. 3 is a table showing ink consumption for printing and maintenance actions in accordance with the present invention.

FIG. 4 is a table showing a plurality of user profiles in accordance with the present invention.

FIG. 5 is a table showing a plurality of maintenance algorithms in accordance with the present invention.

DETAILED DESCRIPTION OF THE PREFERRED EMBODIMENTS

Postage printing systems are well known in the art. Generally, these systems are readily available from manufacturers such as Pitney Bowes Inc. of Stamford, Conn. They often include a variety of different modules which automate the processes of producing mailpieces. A typical high end postage printing system includes a variety of different modules or sub-systems where each module performs a different task on the mailpiece, such as: singulating (separating the mailpieces one at a time from a stack of mailpieces), weighing, moistening/sealing (wetting and closing the glued flap of an envelope), applying/printing evidence of postage, accounting for postage used and stacking finished mailpieces. However, the exact configuration of each postage printing system is particular to the needs of the user. Customarily, the high end postage printing system also includes a transport apparatus which feeds the mailpieces in a path of travel through the successive modules of the postage printing system.

Figure 1:
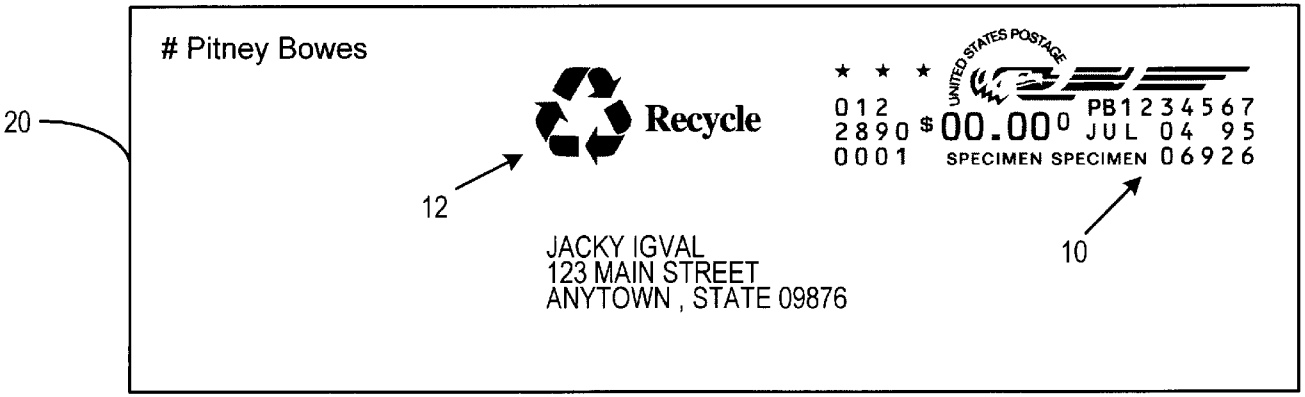
FIG. 1 is an example of a postal indicia and an ad slogan that may be printed by a postage printing system of the present invention.

Referring to FIG. 1, a postal indicia 10 of the type that is commonly printed on a mailpiece 20 (envelope, tape strip, post card or the like) is shown. The postal indicia 10 supplies evidence to the appropriate Postal Authority that the amount of postage indicated has been properly accounted for. Also printed on the envelope 20 is an ad slogan 12 used by the sender to communicate a message to the recipient of the mailpiece 20. Generally, a postage printing system (not shown) prints the ad slogan 12 as well as the postal indicia 10.

Figure 2:
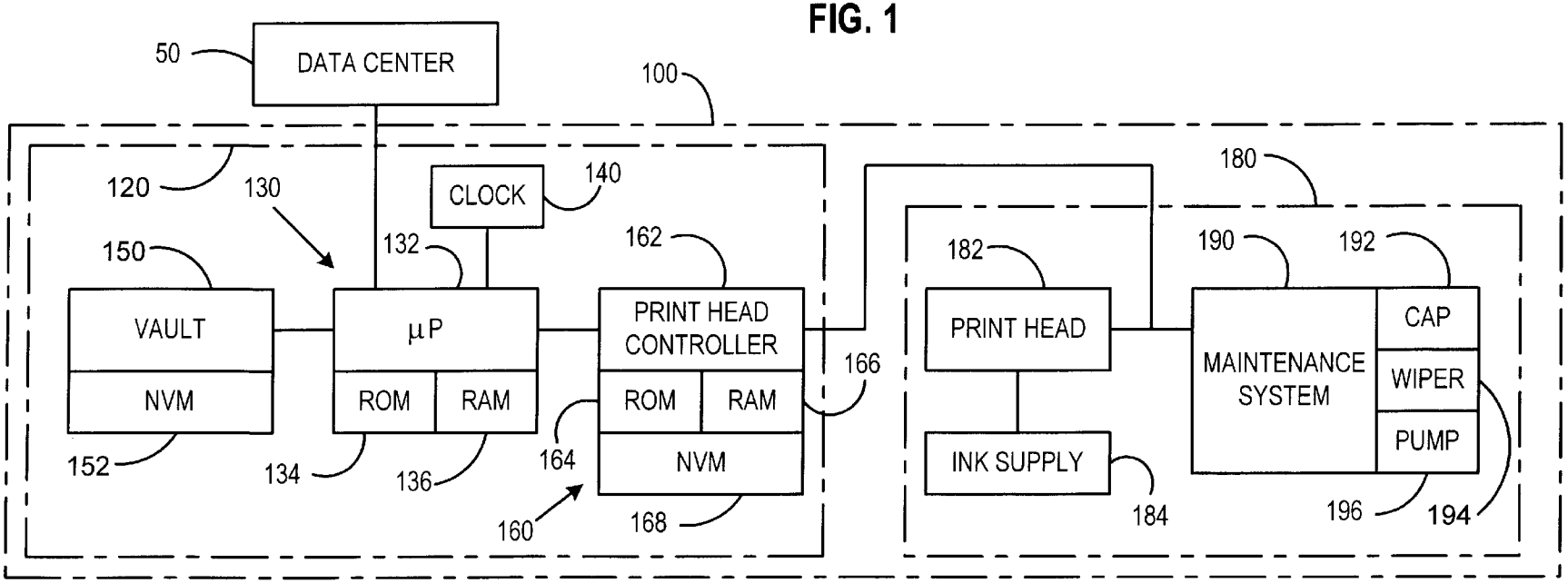
FIG. 2 is a simplified schematic of the postage printing system of the present invention.

Referring to FIG. 2, a simplified schematic of a postage printing system 100, including a postage metering portion 120 and a conventional printing portion 180, in communication with a data center 50 is shown. Periodically, the postage metering portion 120 of the postage printing system 100 must contact the data center 50 to download postal funds or for remote inspections. Typically, this is accomplished over ordinary telephone lines.

The postage metering portion 120 includes a central micro controller 130, a clock 140, a vault module 150 and a printer controller module 160. The central micro controller 130 includes a suitable processor 132, an associated read only memory (ROM) 134 and an associated random access memory (RAM) 136. The clock 140 is in communication with the processor 132 for providing real time clock data. The vault module 150 accounts for postage used and includes a non-volatile memory (NVM) 152 for storing various accounting and postal information (not shown), such as: an ascending register, a descending register, a control sum register and a postal identification serial number. The vault module 150 is also in communication with the processor 132 for receiving appropriate read and write commands from the processor 132. The printer controller module 160 is also in communication with the processor 132 and includes a print head controller 162 an associated ROM 164, an associated RAM 166 and an associated NVM 168. The print head controller 162 oversees operation of the printer portion 180 by providing suitable drive signals and other instructions. Alternatively, the printer controller module 160 could be located within the printing portion 180.

Referring to FIGS. 1 and 2, the printing portion 180 includes conventional components as are known in the art: a print head 182, a supply of ink 184 and a maintenance system 190 having a cap 192, a wiper blade 194 and a pump 196. In a maintenance position (not shown), the print head 182 is sealed off from ambient air by the cap 192, while in a print position (not shown), the print head 182 is located proximate to the mailpiece 20 so as to print the postal indicia 10 and ad slogan 12. The wiper blade 194 periodically cleans the print head 182 to remove any excess ink or other debris (not shown) that may have accumulated on the print head 182. The pump 196 is coupled to the cap 192 and selectively energized in response to signals from the print head controller 162 so as to produce a negative pressure at the cap 192. In this manner, ink 184 can be drawn out of the print head 182 while the print head 182 is in the maintenance position. Additionally, the print head 182 receives suitable drive signals from the print head controller 162 so as to selectively energize the plurality of ejection elements (not shown).

Referring to FIG. 3, a table 200 listing a plurality of printing actions, a plurality of maintenance actions and the relative amount of ink consumed for each action is shown. Wiping and capping actions do not consume any ink. Of the remaining actions, a normal flush consumes the least amount of ink. Thus, the values indicated for the relative amounts of ink consumed are normalized with respect to the amount of ink consumed for the normal flush. For example, a power flush consumes twelve (12) times as much ink as a normal flush. Those skilled in the art will appreciate that the table 200 is provided merely for illustrative purposes. The exact maintenance actions and values of ink consumed can be adjusted depending upon a particular ink formulation and the overall printer design and performance specifications.

Referring to FIG. 4, a table 300 listing a plurality of user profiles is shown. Each of the plurality of user profiles has been selected to represent different usage patterns that have been recognized through empirical testing and user surveys. User #1 processes approximately twenty five (25) mailpieces 20 per week on a random basis through out the week. This type of usage pattern is typical of a home office or other small office that does not generate many outgoing mailpieces. User #2 processes approximately one hundred (100) mailpieces 20 per week fairly uniformly through out the week. In this case, the postage printing system 100 experiences constant random usage over the course of the entire day where the batch runs are very small. This type of usage pattern is typical of a small business that does not have a dedicated operator. Thus, each person having outgoing mailpieces 20 must use the postage printing system 100 themselves.

Like User #2, User #3 processes approximately one hundred (100) mailpieces per week fairly uniformly through out the week. However, the usage pattern is for a single batch run in both the morning and the afternoon where the batch runs are approximately ten (10) mailpieces. This type of usage pattern is typical of a small business having a dedicated operator and mail pick-up twice per day. Generally, in this environment the outgoing mailpieces 20 are accumulated through out the day by the dedicated operator and processed just prior to mail pick-up, once in the morning and once in the afternoon.

User #4 is different from Users #1–3 and User #5 in that User #4 experiences mailing activity on Saturday. Thus, long idle periods over the weekend are dramatically reduced. Additionally, User #4 processes approximately two hundred (200) mailpieces per week fairly uniformly through out the week where the postage printing system 100 experiences constant random usage. However, at least one batch run during the week is greater than or equal to fifty (50) mailpieces. This type of usage pattern is typical of a small to medium size business that experiences a spike of activity on a regular and predictable basis in addition to their regular mailing activity. As examples, this spike of activity is generally related to mailing bills or reminders to customers or solicitations to potential customers.

User #5 processes approximately four hundred (400) mailpieces per week with the vast majority of those occurring on a single day. This type of usage pattern is typical of a business organization that produces a weekly newsletter or other regular bulk mailing with little other mailing activity. Thus, the postage printing system 100 has long idle periods with little activity but experiences high demand on a regular and predictable basis.

Referring to FIG. 5 while recalling the structure of FIG. 2, a table 400 listing a plurality of maintenance algorithms is shown. Maintenance algorithms #1–5 are loaded into and stored in the NVM 168 of the printer controller module 160 during manufacture of the postage printing system 100. However, only one of the maintenance algorithms #1–5 may be active at a time for controlling the maintenance actions of the printing portion 180. Since capping and wiping occur after every print and during idle periods, these maintenance actions are constant between the plurality of maintenance algorithms. Thus, the table 400 lists the differences between maintenance algorithms #1–5 focusing on the various timing aspects of normal flushes, power flushes, normal purges and power purges.

Maintenance algorithms #1–5 have been developed to suit the particular needs of the various types of users as described above with respect to User Profiles #1–5. Thus, maintenance algorithms #1–5 are targeted for application to User Profiles #1–5, respectively.

With the structure of the postage printing system 100 described as above, the functional characteristics will now be described with reference primarily to FIGS. 4 and 5 in view of the structure of FIG. 2. Maintenance algorithm #1 is the default algorithm while maintenance algorithms #2–4 are alternative maintenance algorithms that may be adopted for use if the usage pattern of the postage printing system 100 permits. Therefore, when the postage printing system 100 is initially installed, maintenance algorithm #1 is used for controlling the maintenance actions of the printing portion 180.

During operation of the postage printing system 100, the processor 132 coordinates the activity between the postage metering portion 120, the printing portion 180 and the data center 120. For each batch run, the processor 132 stores in the NVM 152 a record containing an indication of how the postage printing system 100 is being used. Preferably, this record contains such information about at least one operating characteristic of the postage printing system 100, such as: a batch count, the date and time associated with the batch run (available from the clock 140), maximum idle time, total weekly mailpiece volume, maximum batch count per week, number of batch runs per week and the like. In this manner, a historical log of actual usage is built up over time. Preferably, the NVM 152 operates as a revolving buffer where only the most recent records are kept and contains sufficient space to hold at least four (4) weeks worth of records for even high volume users.

The historical log serves as the basis from which a determination can be made as to which maintenance algorithm might be best suited for the postage printing system 100. When the postage metering portion 120 contacts the data center 50, such as during a postage refill, inspection or other predetermined event, the data center 50 can request the processor 132 to upload the historical log for analysis. Based upon the content of the historical log, the data center 50 may instruct the processor 132 to select any one of the maintenance algorithms #1–5 for subsequent use once normal operations resume. This may be accomplished by comparing the actual usage pattern defined in the historical log to a set of predefined user profiles (User Profiles #1–5). On the other hand, the historical log may be interrogated for each operating characteristic and determination made serially. Some of the factors that the data center 50 may use to make its determination are: total mailpiece count per week, average batch count, maximum batch count and occurrence of mailing activity on Saturdays. Preferably, it is desirable to accumulate several weeks of historical data before any changes to the maintenance algorithm are made.

As examples, the relationship of User Profiles #1–5 to maintenance algorithms #1–5, respectively, will now be described. User Profile #1 represents a very low volume user. Thus, the postal indicia printing activity is insufficient to keep the print head 182 in proper working order since the ink is likely to become stale and clog the nozzles (not shown). As a result, maintenance algorithm #1 includes a full range of maintenance actions scheduled through out the week to ensure that the postage printing system 100 is always ready for use and prints quality postal indicias. User Profile #2 represents a significant increase in total volume over User Profile #1. Although the total volume has increased rendering the power purge unnecessary, the average batch count remains very low. Thus, only slight modifications are allowed. Maintenance algorithm #2 skips the power purge and inserts an extra normal purge over maintenance algorithm #1. User Profile #3 exhibits the same total volume as User Profile #2, but, the average batch count is significantly greater. Since the batch counts are higher and the batch runs occur in both the morning and the afternoon, ink consumption is more conducive to keeping the print head 182 in proper working order. Thus, modifications may be achieved and maintenance algorithm #3 is the result.

User Profile #4 represents a significant increase in total volume over User Profile #2 and User Profile #3. Additionally, two important other factors are present: (i) Saturday mailing activity; and (ii) a batch count greater than fifty (50). Saturday mailing activity functions to greatly reduce the long idle periods which occur over weekends. Thus, the Monday morning normal purges that are found in the other user profiles are not necessary. As a result, maintenance algorithm #4 is modified accordingly.

Although User Profile #5 represents the highest total volume user, the usage pattern is heavily weighted to a single day and not distributed through out the week. Thus, the heavy usage on Friday will sporadic usage on other days is not sufficient to eliminate normal purges all together. As a result, maintenance algorithm #4 is modified accordingly.

It should now be apparent to those skilled in the art that for users having the same weekly volume the ink consumed for some users during maintenance actions is lower than for other users. Where usage patterns have permitted, some maintenance actions have been eliminated completely or modified. The result is a maintenance algorithm more targeted to the needs of the user yielding greater efficiency for ink consumption and lowering overall costs.

The user profiles and maintenance algorithms described above have been provided primarily for illustrative purposes. Numerous user profiles may be uncovered and a plurality of different maintenance algorithms can be developed. For example, as an extension of the present invention, the data center 50 may collect many different historical logs from a plurality of postage printing systems 100. Using these historical logs, the data center 50 may identify additional user profiles, other than those described above, that had not been anticipated. In response to these additional user profiles, the data center 50 may develop corresponding maintenance algorithms and download them accordingly to the postage printing systems.

Many features of the preferred embodiment represent design choices selected to best exploit the inventive concept as implemented in a postage printing system regardless of whether bubble jet or piezoelectric technology is employed or whether or not the ink supply package with the print head or located remotely. Those skilled in the art will recognize that the inventive aspects of the present invention may be applied to other ink jet printers. Additionally, those skilled in the art will recognize that various modifications can be made without departing from the spirit of the present invention. For example, instead of having the data center select a new maintenance algorithm after uploading the historical log, the processor can be programmed to perform the same analysis that the data center does on a periodic basis.

As another example, in one alternative only a single maintenance algorithm could be loaded into the postage printing system to save on memory space. In this case, the data center would contain the user profiles and would download a new maintenance algorithm, if necessary, to replace the existing one.

Therefore, the inventive concept in its broader aspects is not limited to the specific details of the preferred embodiments but is defined by the appended claims and their equivalents.

What is claimed is:

1. A method of operating a postage printing system having an ink jet printer, comprising the step(s) of:

using one of a plurality of maintenance algorithms to control timing of a maintenance action;

keeping a historical log of an operating characteristic of the postage printing system over a period of time;

associating the plurality of maintenance algorithms with a plurality of user profiles representative of different usage patterns with respect to the operating characteristic;

determining which one of the plurality of user profiles is best suited to the historical log; and selecting the one maintenance algorithm corresponding to the determined one of the plurality of user profiles as the one maintenance algorithm for subsequent use by the postage printing system.

2. The method of claim 1, further comprising the step(s) of:

uploading the historical log to a data center;

using the data center to determine which one of the plurality of user profiles is best suited to the historical log; and receiving an indication from the data center of the one maintenance algorithm.

3. The method of claim 2, further comprising the step(s) of:

using the data center to:

(i) collect a plurality of historical logs;

(ii) identify a new user profile different from the plurality of user profiles;

(iii) develop a new maintenance algorithm associated with the new user profile; and (iv) download the new maintenance algorithm to a selected postage printing system.

4. The method of claim 1, wherein:

the operating characteristic is total weekly volume.

5. A method of operating an ink jet printer, comprising the step(s) of:

using one of a plurality of maintenance algorithms to control timing of a maintenance action;

keeping a historical log of an operating characteristic of the ink jet printer over a period of time;

associating the plurality of maintenance algorithms with a plurality of user profiles representative of different usage patterns with respect to the operating characteristic;

determining which one of the plurality of user profiles is best suited to the historical log; and selecting the one maintenance algorithm corresponding to the determined one of the plurality of user profiles as the one maintenance algorithm for subsequent use by the ink jet printer.

6. A postage printing system having an ink jet printer, comprising:

a memory including a plurality of maintenance algorithms for controlling timing of a maintenance action; and control means for:

keeping a historical log of an operating characteristic of the ink jet printer over a period of time;

associating the plurality of maintenance algorithms with a plurality of user profiles representative of different usage patterns with respect to the operating characteristic;

determining which one of the plurality of user profiles is best suited to the historical log; and selecting one of the plurality of maintenance algorithms in the memory corresponding to the determined one of the plurality of user profiles as the one maintenance algorithm for subsequent use by the ink jet printer.

7. The postage printing system of claim 6, wherein:

the control means is further for uploading the historical log to a data center; and the data center is for determining which one of the plurality of user profiles is best suited to the historical log and providing an indication to the postage printing system of the one maintenance algorithm.

8. The postage printing system of claim 7, wherein:

the data center is further for:

(i) collecting a plurality of historical logs;

(ii) identifying a new user profile different from the plurality of user profiles;

(iii) developing anew maintenance algorithm associated with the new user profile; and (iv) downloading the new maintenance algorithm to a selected postage printing system.

9. The postage printing system of claim 8, wherein:

the operating characteristic is total weekly volume.

10. An ink jet printer, comprising:

a memory including a plurality of maintenance algorithms for controlling timing of a maintenance action; and control means for:

keeping a historical log of an operating characteristic of the ink jet printer over a period of time;

associating the plurality of maintenance algorithms with a plurality of user profiles representative of different usage patterns with respect to the operating characteristic;

determining which one of the plurality of user profiles is best suited to the historical log; and selecting one of the plurality of maintenance algorithms in the memory corresponding to the determined one of the plurality of user profiles as the one maintenance algorithm for subsequent use by the ink jet printer.

* * * * *